US005709245A

United States Patent [19]

Miller

[11] Patent Number: 5,709,245

[45] Date of Patent: Jan. 20, 1998

[54] OPTICALLY CONTROLLED ACTUATOR

[75] Inventor: Glen E. Miller, Redondo, Wash.

[73] Assignee: The Boeing Company, Seattle, Wash.

[21] Appl. No.: 720,320

[22] Filed: Sep. 27, 1996

Related U.S. Application Data

[63] Continuation of Ser. No. 634,079, Apr. 17, 1996, abandoned, which is a continuation of Ser. No. 311,465, Sep. 23, 1994, abandoned.

[51] Int. Cl.[6] ..... F15B 13/043

[52] U.S. Cl. ..... 137/625.64; 137/625.62; 251/129.04

[58] Field of Search ..... 137/625.62, 625.64; 251/129.04

[56] References Cited

U.S. PATENT DOCUMENTS

| | | | |
|---|---|---|---|
| 3,612,882 | 10/1971 | Sheppard | 250/208 |
| 4,132,378 | 1/1979 | Stevens | 244/175 |
| 4,306,314 | 12/1981 | Griffiths | 455/603 |
| 4,443,853 | 4/1984 | Maciolek et al. | 364/434 |
| 4,651,045 | 3/1987 | Wagner | 310/328 |
| 4,660,589 | 4/1987 | Bartholomew | 137/83 |
| 4,716,399 | 12/1987 | Nordlund | 340/364 |
| 4,742,678 | 5/1988 | Bartholomew et al. | 60/516 |
| 4,931,635 | 6/1990 | Toyama | 250/225 |
| 5,033,694 | 7/1991 | Sato | 244/78 |
| 5,044,155 | 9/1991 | Zimmerman | 60/224 |
| 5,085,125 | 2/1992 | Emo et al. | 91/459 |

*Primary Examiner*—Gerald A. Michalsky
*Attorney, Agent, or Firm*—Conrad O. Gardner

[57] ABSTRACT

Fiber optics and photovoltaic devices for optically controlling a conventional Electro-Hydraulic Valve (EHV) without need for external wiring. One laser, one fiber and one photocell located at the EHV are electrically passive, and inherently reliable. The system is much less susceptible to hard-over failure and unsymmetrical control because changes in any one of these elements will affect both directions equally.

2 Claims, 6 Drawing Sheets

Fig. 2.
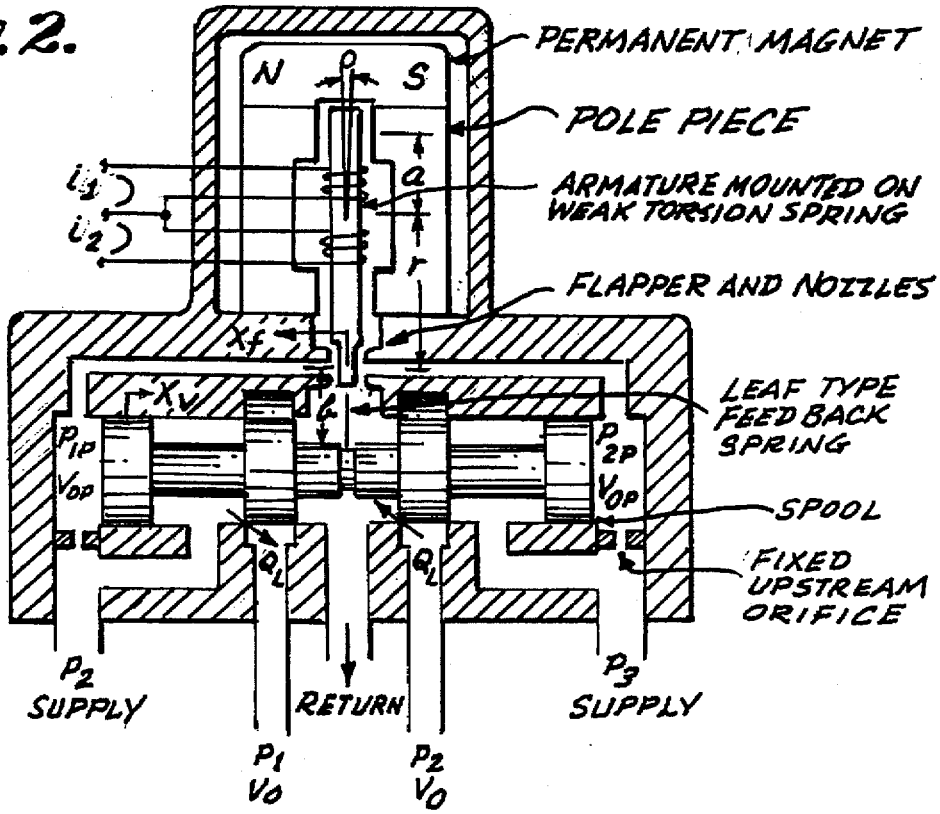
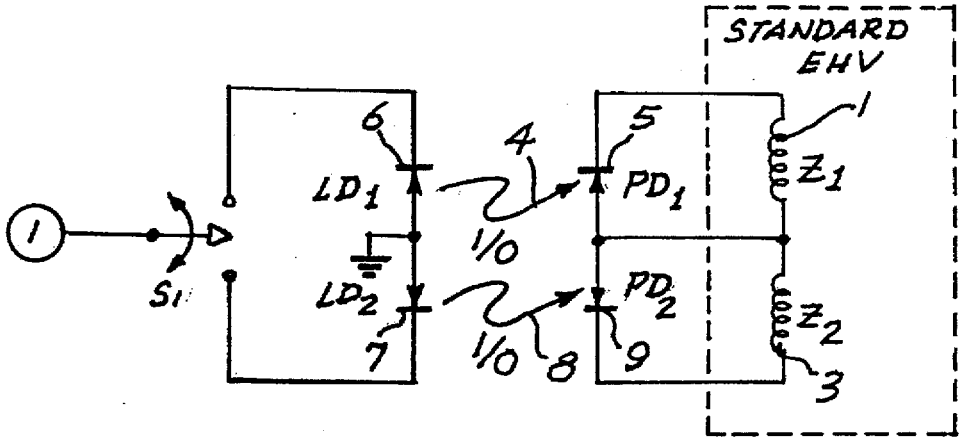
Fig. 3.
ONE CURRENT SOURCE
ONE TRANSISTOR SWITCH
TWO 0.5 WATT CW LASERS (SAME WAVE LENGTH)
TWO FIBERS
TWO HIGH-EFFICIENCY PHOTODIODES

OPTICALLY CONTROLLED ACTUATOR

This application is a continuation of prior application number U.S. Ser. No. 08/634,709, filed Apr. 17, 1996, now abandoned which is a continuation of prior application Ser. No. 08/311,465, filed Sep. 23, 1994, now abandoned, also assigned to the Boeing Company.

BACKGROUND OF THE INVENTION

The present invention relates to hydraulic actuators and more particularly to optically-controlled hydraulic actuators.

Hydraulic actuators are used extensively in industry, in earth-moving equipment, and in transportation. Actually, they find use in any application where a small control command must cause the movement of a heavy load. Aircraft flight control, where a command generated by the pilot or by a computer is required to rapidly change the position of a massive control surface, is a good example. Major elements of an aircraft flight-control system include:

1. A command sensor, by means of which the pilot dictates the desired position of a flight-control surface. It responds to the pilot's commands and interprets them in terms understood by a flight-control computer;
2. A feedback sensor which continuously provides the flight control computer with the actual control surface position data, also in terms understood by a flight-control computer;
3. A flight-control computer, which continuously compares the pilot's commanded position with the actual position of the control surface, determines the amount of correction needed, and send the actuator the command necessary to make that correction; and
4. An actuator which responds to that command by moving the control surface to the command position.

In the usual flight control applications, the actuator is a bi-directional hydraulic cylinder which derives its motive power from pressurized hydraulic fluid supplied from an external source. The flow of hydraulic fluid into either end of the cylinder is governed by a control valve which responds proportionally to an electrical command from the flight-control computer.

Typically, the command sensor, the feedback sensor, and the control valve are all electrical, and the interconnections between them and the flight-control computer are made by wire. The objective of present "Fly-by-Light" programs is to replace the electrical sensors and the electrical control valve with optical equivalents, and to replace the interconnections with fiber optics. The principal reason for changing from electrical to optical is to reduce the susceptibility of the system to natural and man-made electrical interference.

Fiber optic interconnects and sensors for command and feedback have been under development for many years and are nearly perfected. However, optical actuator control is not yet perfected and, without it, a total flight control system cannot realize the full benefits of fly-by-light technology. Practical means must be developed and qualified for optically controlling the hydraulic muscles, or actuators, which move the various control surfaces. To insure maximum EMI (electromagnetic interference) immunity, it is preferable that all controls be accomplished without external electrical power connections to the actuators.

It should eventually be possible to control the flow of high-pressure hydraulics directly through optics, and without an intermediate electrical interface. The quest for a means by which to accomplish this has led to several diverse and novel solutions involving optothermal, optoacoustic, and optofluidic effects. Although these potential solutions to the problem have all been demonstrated with various degrees of success, at the current stage of development they usually appear to be either too inefficient, too temperature-sensitive, or too slow for most flight-control applications.

Prior art patent literature includes:

U.S. Pat. No. 4,306,314 issued Dec. 15, 1981 where flow of fluid is controlled by means of a solenoid-actuated valve and wherein active electronics, both analog and digital are co-located within the valve. Optical power requirement is not proportional to actuator velocity. The system is pulse width modulated, which means that the optical power output is 50% of maximum when the control loop is idle.

U.S. Pat. No. 4,651,045 issued Mar. 17, 1987, "Electromagnetically Interference-Proof Control Device." This patent describes a system for controlling the flow of hydraulic fluid through an electrohydraulic valve in response to a remote optical command transmitted through an optical fiber and with no external electrical connections. Flow of fluid is controlled by means of an Electro-Hydraulic Valve, and particularly (but not necessarily) one using piezoelectric control elements. A piezoelectric electrical generator is powered hydraulically by a fluidic oscillator.

U.S. Pat. No. 5,085,125 issued Feb. 4, 1992, "Optically Controlled Transducer." A system is described for controlling the flow of hydraulic fluid through an electrohydraulic valve in response to remote optical commands transmitted through a plurality of optical fibers, but with no external electrical connections.

This system has the following characteristics:

1. The control valve assembly contains some active electronics (photo-SCR).
2. The assembly operates from electrical power produced by a piezoelectric element driven by a pneumatic oscillator.
3. The control valve itself uses a conventional jet-pipe configuration which is positioned by sets of piezoelectric elements on each side which have binarilly-weighted electrical taps along their lengths.
4. Each tap on each stack is controlled by its own unique fiber. A simple bang-bang control (single bit binary) would require two fibers.

A three-level control would require four fibers, a seven-level control would require 6 fibers, etc.

SUMMARY OF THE INVENTION

A system for controlling the flow of hydraulic fluid through an electrohydraulic valve in response to a remote electrical command, but without the usual electrical connections between the control valve and the command source. Instead, the electrical command is used to intensity-modulate a light source (a laser or a light-emitting diode) with one or more amplitude-modulated carriers. The intensity-modulated light is transmitted by an optical path (preferably an optical fiber) to a valve interface unit consisting of a photovoltaic cell, a series of resonant electrical circuits and impedance-matching networks which respond selectively to the carrier frequencies with which the light is modulated. Each of the filtered carriers is rectified to produce a direct current which is used to drive an element of the control valve or valves.

This system has the following characteristics:

1. Flow of fluid is controlled by an Opto-Hydraulic Valve (OHV) assembly.
2. That OHV assembly consists of a conventional Electro-Hydraulic Valve (EHV), modified to contain an optoelectric interface module. That EHV has the ability to control the flow of hydraulic fluid into, and out of, a hydraulic actuator in response to an electrical control input.

3. The interface module converts an optical control input into the electrical input needed for control of the EHV, and does so with no requirement for an additional source of electrical power.
4. The OHV assembly contains no active electronics.
5. The OHV assembly requires no externally-provided source of electrical power.
6. The OHV assembly requires no internally-generated source of electrical power, i.e., NO batteries, NO electrical generators driven pneumatically, hydraulically or otherwise.
7. The OHV assembly can completely control fluid flow rate (or actuator velocity) and direction, and this is accomplished with a single optical input to the OHV, with one light source, one fiber and one detector.
8. The system is easily expandable to control additional valves or other electrical loads with the same one light source, one fiber and one detector.
9. The optical power input requirement to the OHV is proportional to actuator velocity and, during idle loop conditions, can be less than 10 percent of the power required for valve full-flow conditions. This can significantly increase the life expectancy of the laser or other light source.
10. Considering the optical input to the photovoltaic cell and the electrical output to the EHV, an optical-to-electrical efficiency near 30% has been achieved.

BRIEF DESCRIPTION OF THE DRAWINGS

The present invention is described hereinafter in detail with reference to the drawings in which:

FIG. 2 is illustrative of electro-hydraulic control valves having two differential current inputs;

FIG. 3 is illustrative of the simplest means for controlling an EHV optically;

DETAILED DESCRIPTION

THE PROBLEM

Figure 1:
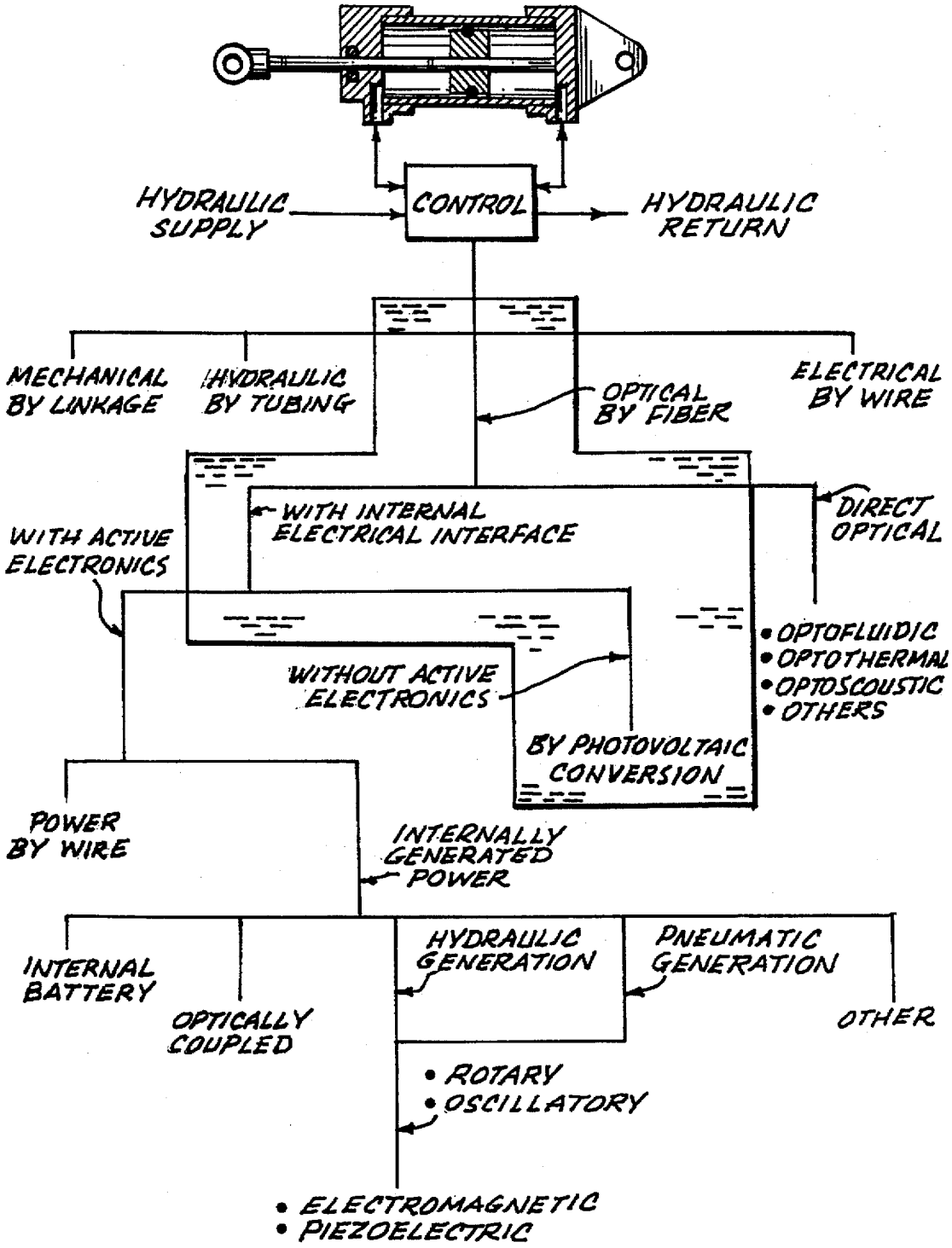
FIG. 1 is illustrative of various means for remotely controlling the flow of hydraulic fluid through a double-acting hydraulic actuator.

FIG. 1 shows various means for remotely controlling the flow of hydraulic fluid through a double-acting hydraulic actuator. The simplest means involves mechanical or hydraulic linkage for directly operating a four-port control valve attached directly to the actuator, but these means do not adapt well to separation distances greater than a few feet, nor do they interface conveniently with computers and other electronics. Because most aircraft flight controls involve considerable separation distances and are required to interface with electronics, actuator control means are usually electrical, and the electrical/hydraulic interface function is performed by an Electro-Hydraulic Control Valves (EHVs) having two differential current inputs similar to that shown in FIG. 2.

There are several ways that the hydraulic actuator can be controlled by such an EHV and done with no external electrical connections. One way uses fiber optic signaling combined with an optical/electrical interface which is totally internal to the actuator, and this can be done with or without active electronics in the actuator.

If active electronics are allowed within the actuator, it can be done with lower-powered and high reliable light sources such as LEDs, provided that a source of electrical power is available within the actuator. That internal electrical power source can be long-life batteries, or it can be derived from bypass hydraulic power driving a rotating or oscillatory electrical generator. The electronics can also be powered by light through an independent fiber link to an external light source of sufficient power, in which case modulation bandwidth of this light source is not a consideration so it can even be an incandescent or contained-arc device with sufficient power and the necessary reliability.

The present invention in contrast relates to the control of an actuator by means of an EHV, but without external electrical connections, and without active electronics in the EHV. These options are illustrated by the shaded area of FIG. 1. This can be done by including an optical-to-electrical converter as simple as a pair of photovoltaic cells to drive the EHV directly, provided that those cells and their light sources have sufficient modulation bandwidth to meet system requirements, and provided that the combination is capable of supplying the 60 milliwatts or so of electrical power required to drive a typical EHV to the full-flow condition.

Following are several potential solutions and their associated problems.

METHOD I

FIG. 3 shows the simplest means for controlling an EHV optically. In this configuration, each of the two differential inputs to the EHV is fed by a separate fiber optic link consisting of a controllable light source, a fiber path, and a photovoltaic device. In FIG. 3, the upper coil (1) of EHV (2) is energized through a fiber optic link consisting of light source (6), fiber path (4), and photo voltaic device (5). The lower coil (3) of EHV (2) is energized through a fiber optic link consisting of light source (7), fiber path (8), and photovoltaic device (9). Current through light source (6) results in current through the upper coil (1) of EHV (2), which would cause an associated actuator to move in one direction. Current through light source (7) results in current through the lower coil (3) of EHV (2), which would cause an associated actuator to move in the opposite direction. If current flows simultaneously through both light sources (6) and (7), then the actuator would move in the direction associated with the greater of the two currents, and at a rate proportional to the magnitude of that difference.

The disadvantage of this configuration is that failure of any one light source, any one fiber path, or any one photovoltaic device would allow the actuator to move in one direction only and be unable to move in the opposite direction.

METHOD II

Figure 4:
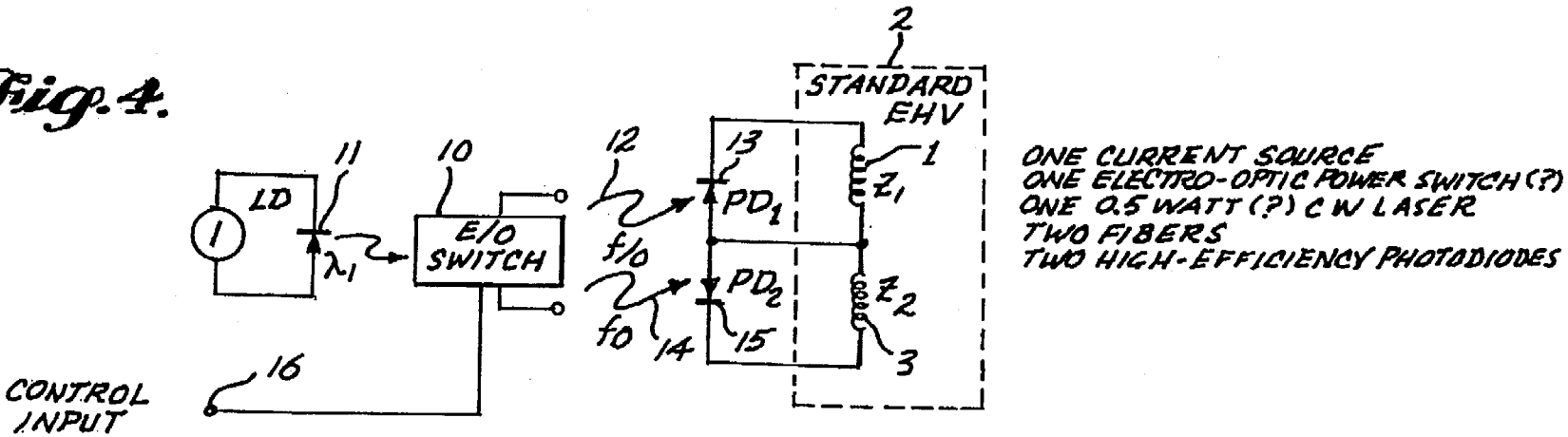
FIG. 4 is illustrative of a further means for optically controlling an EHV.

FIG. 4 shows another simple means for optically controlling an EHV. In this configuration, an electro-optic (E/O) switch (10) switches a single controllable light source (11) between the upper coil and the lower coil of the EHV. The upper coil (1) of EHV (2) is energized through fiber optic link (12) and photo voltaic device (13). The lower coil (3) of EHV (1) is energized through fiber optic link (14) and photovoltaic device (15). Light through fiber path (12) results in current through the upper coil (1) of EHV (2), which would cause an associated actuator to move in the opposite direction. The controllable light source (11) is switched between the two paths (12) and (14) by means of switching device (10) which might, for example, be a solid-state device or an opto-mechanical device. Switching between the two paths is determined by a signal applied to control input (16). The actuator moves in the direction associated with the greater average intensity in the two paths, and at a rate proportional to the magnitude of difference of the two intensities.

Even if it were possible to select a switch (10) suitable for a given application, the disadvantage of this configuration is that failure of the switch, either fiber path, or either photovoltaic device would allow the actuator to move in one direction only and be unable to move in the opposite direction.

METHOD III

Figure 5:
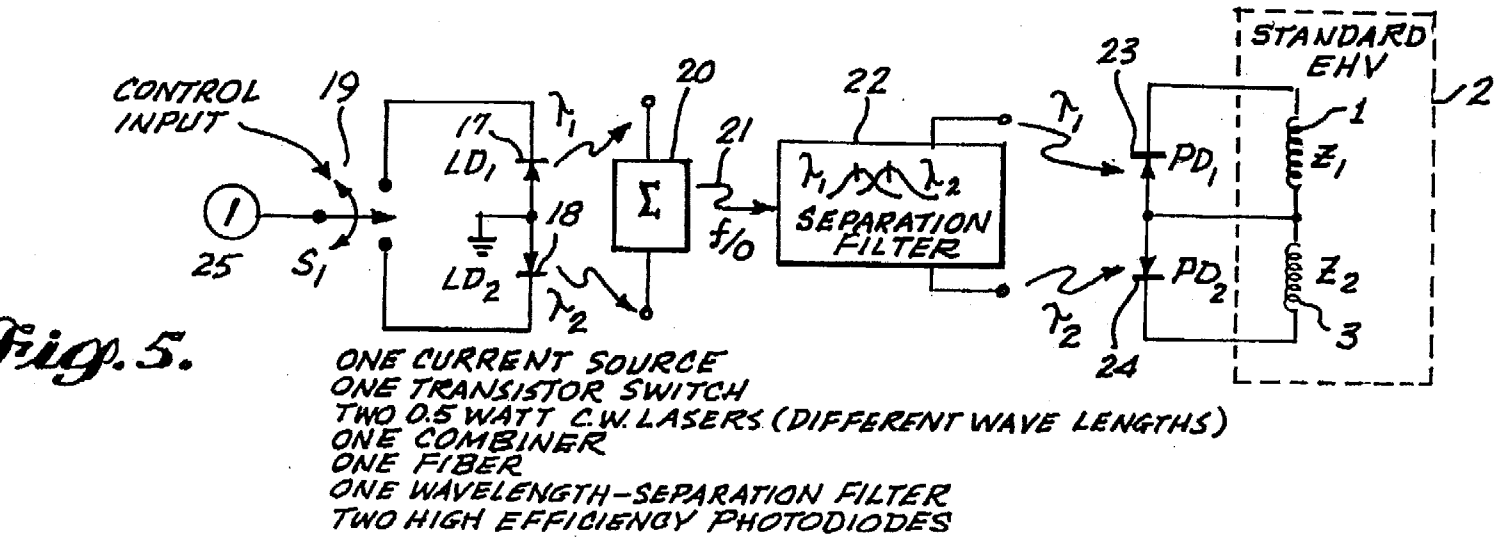
FIG. 5 is illustrative of yet another means for controlling an EHV optically.

FIG. 5 shows another means for controlling an EHV optically. In this configuration, two controllable light sources (17) and (18) are switched by control input (19) into a summing junction (20) then into a single fiber optic path (21). Controllable light source (17) operates at a wavelength $\lambda_1$, and controllable light source (18) operates at a different wavelength $\lambda_2$. Control input (19) determines the ratio of light intensities at the two wavelengths present in fiber path (21) at any given time.

At the EHV (2), light at the two wavelengths is separated into two paths by separation filter (22). Light at wavelength $\lambda_1$ is coupled to photovoltaic device (23), and light at wavelength $\lambda_2$ is coupled to photovoltaic device (24). The electrical output of photovoltaic device (23) energizes the upper coil (1) of EHV (2), and the electrical output of photovoltaic device (24) energizes the lower coil (3) of EHV (2).

It follows that current through light source (17) causes light at wavelength $\lambda_1$ to be coupled into photovoltaic device (23), which results in a current through the upper coil (1) of EHV (2). It also follows that current through light source (18) causes light at wavelength $\lambda_2$ to be coupled into photovoltaic device (24), which results in a current through the lower coil (3) of EHV (2).

Division of current from current source (25) between light sources (17) and (18) is determined by the signal applied to control input (19). Although (19) is depicted in FIG. 5 as a switch, in actual application it would consist of suitable solid state circuitry. The actuator moves in the direction associated with the greater average intensity in the two paths, and at a rate proportional to the magnitude of difference of the two average intensifies.

This configuration is somewhat better than configurations I and II, because there is only one fiber path instead of two. However, failure of either light source or either photovoltaic device would allow the actuator to move in one direction only and be unable to move in the opposite direction.

SYSTEM OF PRESENT INVENTION (METHOD IV)

Figure 6:
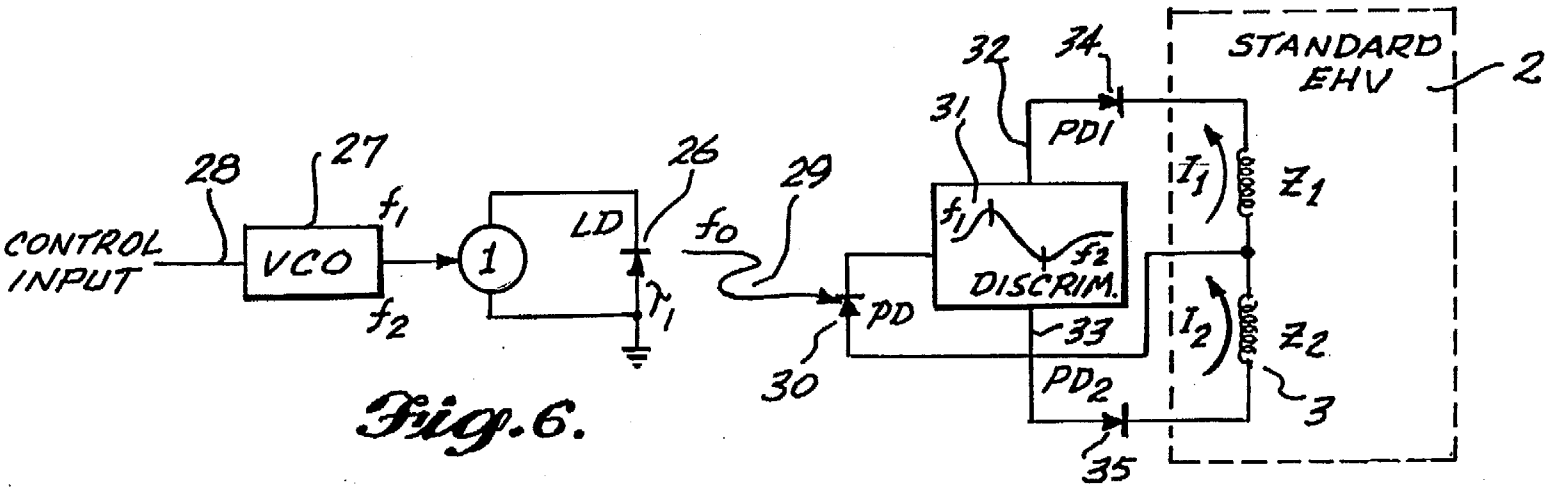
FIG. 6 is illustrative of a means for controlling an EHV optically in accordance with the present invention, but without the disadvantages of the methods shown in FIGS. 3, 4, and 5 respectively.

A system in accordance with the present invention as shown in FIG. 6. This shows another means for controlling an EHV optically, but without most of the disadvantages of the methods shown in FIGS. 3, 4, and 5 respectively.

In the configuration of FIG. 6, one controllable light source (26) is intensity-modulated by a frequency-modulated oscillator (27), the frequency of which is controlled between limits of $f_1$ and $f_2$ by a voltage applied at control input (28), voltage $V_1$ producing frequency $f_1$, and voltage $V_2$ producing frequency $f_2$. Light from light source (26) is coupled by a single fiber optic path (29) to a single photovoltaic device (30) which has, as an output, a reproduction of the intensity modulation applied to light source (26). The output of photovoltaic device (30) is coupled to a double-tuned frequency discriminator (31) which has two outputs (32) and (33), output (32) tuned to peak at frequency $f_1$ but reject frequency $f_2$, and output (33) tuned to peak at frequency $f_2$ but reject frequency $f_1$. Output (32) is rectified by diode rectifier (34) to produce a DC current $I_1$ into the upper (1) of EHV (2). Output (33) is rectified by diode rectifier (35) to produce a DC current $I_2$ into the lower coil (3) of EHV (2).

Figure 8:
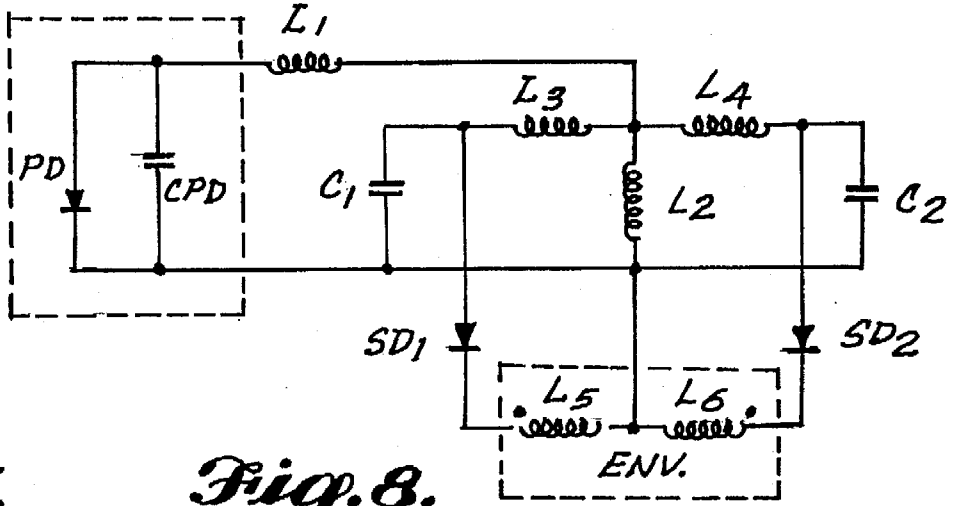
FIG. 8 is a schematic diagram exemplary of a discriminator circuit of the system of FIG. 6.
Figure 7:
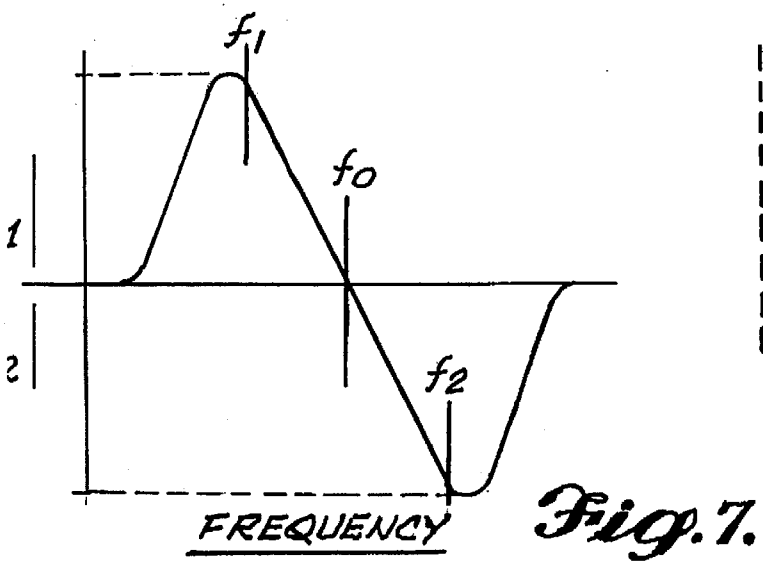
FIG. 7 is a plot of a typical transfer function for the system of FIG. 6.
Figure 9:
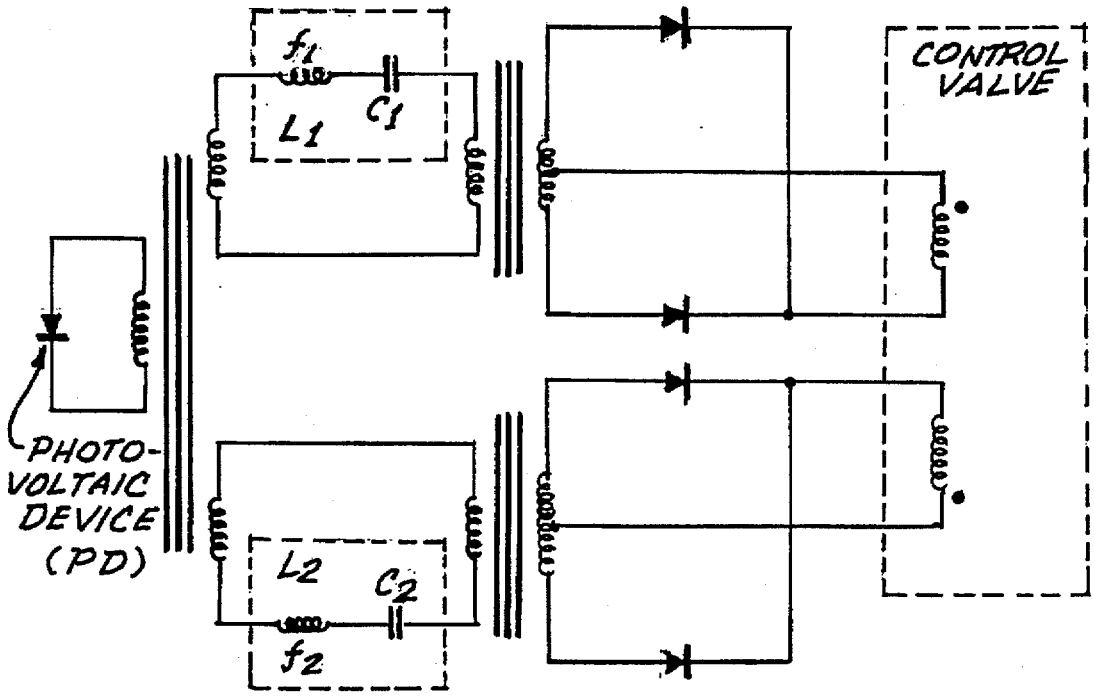
FIG. 9 is a schematic representative of the system of FIG. 6 however having improved actuator electronic circuitry for operation of a 2-coil valve.
Figure 10:
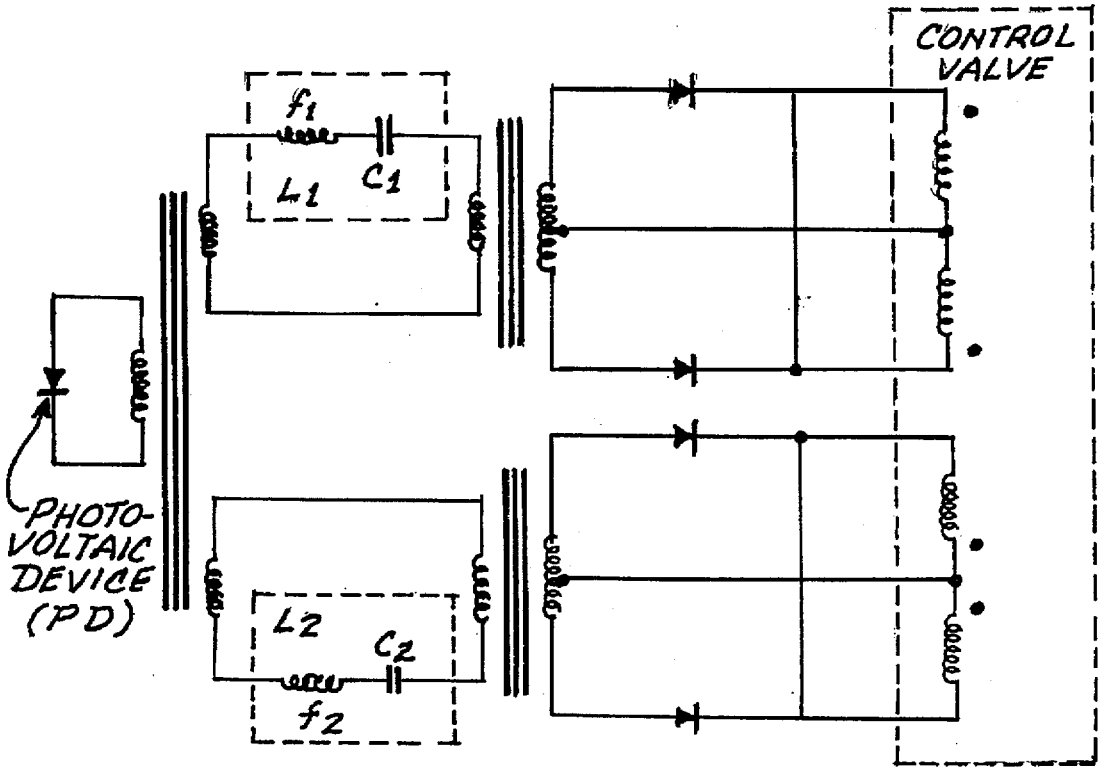
FIG. 10 shows the system of FIG. 9 however, operating a 4-coil valve.
Figure 11:
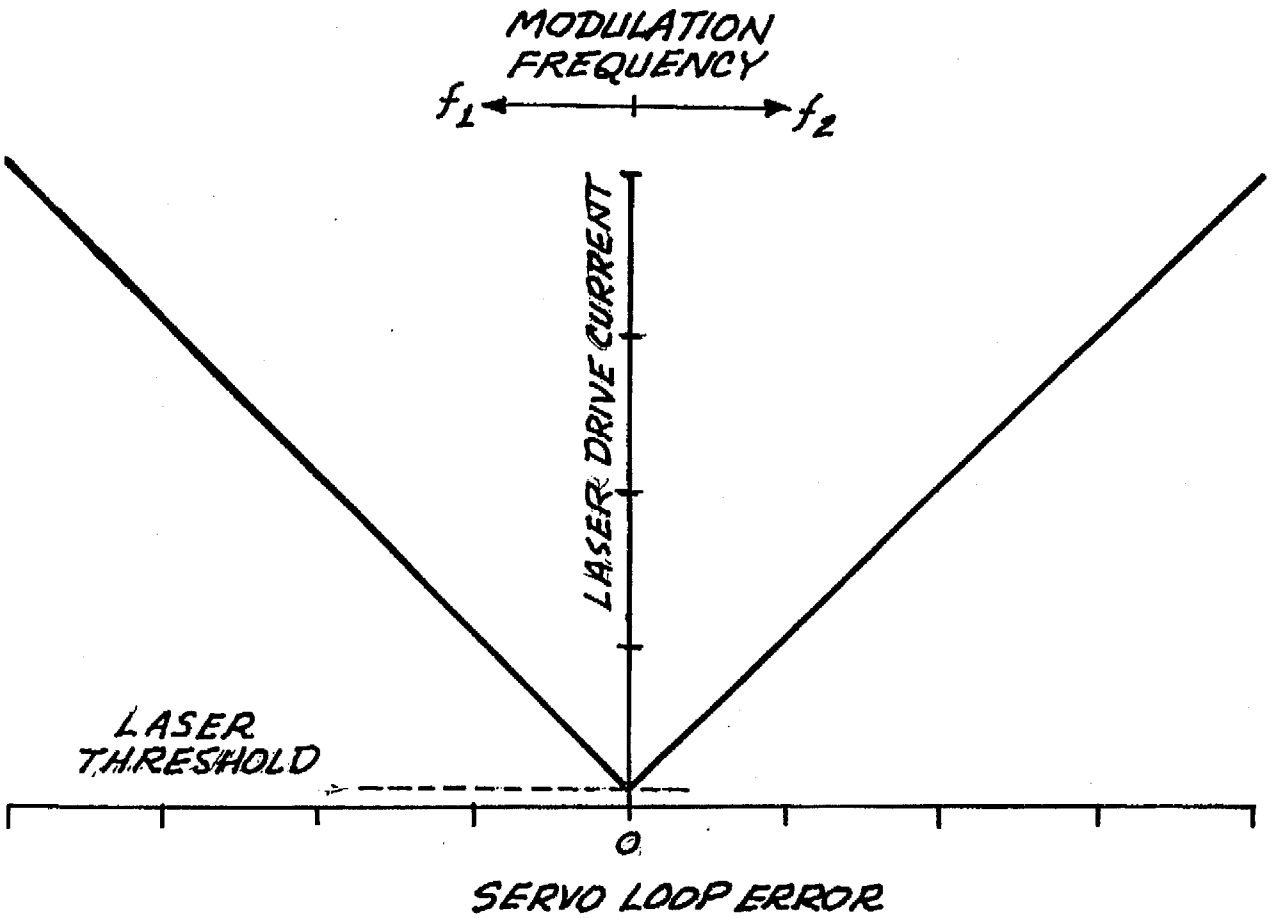
FIG. 11 is a diagram illustrative of the transfer function of the systems of FIGS. 9 and 10.

It follows that a control input voltage of $V_1$ will produce a frequency $f_1$, which will energize the upper coil (1) of EHV (2), which will cause an associated actuator to move in one direction. It follows also that a control input voltage of $V_2$ will produce a frequency $f_2$, which will energize the lower coil (3) of EHV (2), which will cause an associated actuator to move in the opposite direction. The direction of actuator motion is determined by whether the control input voltage is closer to $V_1$ or closer to $V_2$. The velocity of actuator motion is determined by how far the control input voltage deviates from the midpoint between $V_1$ and $V_2$. A typical transfer function is shown in FIG. 7. An example of the design of discriminator (31) is shown in FIG. 8.

ADVANTAGES OF METHOD IV

In most applications, the fiber optic cable and connectors are exposed to the environment and are therefore the components of the system most vulnerable to damage. Methods such as Method I and II above, which use a separate fiber to command motion in each of the two directions, are most subject to catastrophic failure in a "hard over" mode because of the high probability that one path will fail before the other. Methods I, II, and III are all likely to develop unsymmetrical control sensitivities in the two directions, either because of unequal fiber path attenuation, or because of unmatched sources and detectors.

Method IV, which uses only one light source, one fiber, and one photovoltaic device is much less susceptible to hard over failure and unsymmetrical control because changes in any one of these three elements will affect both directions equally.

It is also possible, by any one of several methods, with Method IV to add feedback which will minimize variation of control sensitivity simultaneously in both directions.

High-reliability voltaged-controlled oscillators are readily available, and the frequency discriminator can be designed to use only high-reliability passive components.

In the foregoing specification, the invention has been described with reference to a specific exemplary embodiment thereof. It will, however, be evident that various modifications and changes may be made thereunto without departing from the broader spirit and scope of the inventions as set forth in the appended claims. The specification and drawings are, accordingly to be regarded in an illustrative rather than a restrictive sense.

What is claimed is:

1. An optical control system vfor an electrohydraulic valve comprising in combination:

a light source intensity modulated by an electrical command consisting of at least one amplitude modulated carrier having; a valve interface unit;

an optical path comprising an optical fiber for transmitting the intensity modulated light to said valve interface unit;

said optical path coupled between said light source and said valve interface unit; and said valve interface unit responsive to the frequency of said at least one amplitude modulated carrier with which said light source is modulated.

2. An optical system for an electrohydraulic valve having first and second coils comprising in combination:

a controllable light source intensity modulated by a frequency modulated oscillator;

a photovoltaic device;

a fiber optic path coupled between said controllable light source and said photovoltaic device;

a double tuned frequency discriminator having a first output and a second output;

a first diode rectifier responsive to said first output;

a second diode rectifier responsive to said second output;

said first diode rectifier having an output coupled to said first coil; and, said second diode rectifier having an output coupled to said second coil.

* * * * *